US006499695B1

(12) United States Patent
Talamo

(10) Patent No.: US 6,499,695 B1
(45) Date of Patent: Dec. 31, 2002

(54) BALLOON KITE

(76) Inventor: Robert O. Talamo, 52 Breston Dr. East, Shirley, NY (US) 11967

( * ) Notice: Subject to any disclaimer, the term of this patent is extended or adjusted under 35 U.S.C. 154(b) by 0 days.

(21) Appl. No.: 09/990,218

(22) Filed: Nov. 21, 2001

(51) Int. Cl.[7] ..... A63H 27/08
(52) U.S. Cl. ..... 244/153 R; 244/31
(58) Field of Search ..... 244/153 R, 31

(56) References Cited

U.S. PATENT DOCUMENTS

| | | | | | |
|---|---|---|---|---|---|
| 3,952,975 | A | | 4/1976 | Laske | 244/153 |
| 3,980,260 | A | | 9/1976 | Laske | 244/153 |
| 4,296,704 | A | | 10/1981 | Bridge | 114/103 |
| 4,533,099 | A | | 8/1985 | Stewart | 244/153 |
| 4,722,498 | A | * | 2/1988 | Cameron | 244/153 R |
| 4,815,677 | A | | 3/1989 | Rushing et al. | 244/33 |
| 4,871,133 | A | * | 10/1989 | Alonso | 24/DIG. 11 |
| 4,919,365 | A | * | 4/1990 | Mears | 116/210 |
| 5,762,293 | A | | 6/1998 | Crosbie | 244/33 |
| 6,044,581 | A | | 4/2000 | Shipman et al. | 43/3 |

FOREIGN PATENT DOCUMENTS

| | | |
|---|---|---|
| CA | 2172852 | 9/1997 |

* cited by examiner

*Primary Examiner*—J. Woodrow Eldred
(74) *Attorney, Agent, or Firm*—Island Patent; F. Scott Tierno

(57) ABSTRACT

A balloon kite is formed with a plurality of sized sheets of gas impervious sheet material that form one or more fillable interior chambers. The balloon kite is capable of being flown and deployed in the presence or absence of a critical level of wind. When the critical level of wind is present a balloon kite lifts and assumes an aloft position with the interior chamber or chambers filled with air. If the wind is below the critical level of wind, the balloon kite may be filled with a lighter-than-air gas and flown with a minimal amount of wind, and by an individual having minimal training. The balloon kite is structured with extended and folded portions that provide a simple and low cost reinforced attaching arrangement for securing a bridle and kite flying line to the balloon kite. One or more of the sized sheet is formed with a coiled tail portion. Each coiled tail portion is extendable when uncoiled and useful for stabilizing a balloon kite when in an aloft position.

16 Claims, 7 Drawing Sheets

START

200
IS CRITICAL WIND PRESENT ?
NO
YES
206
NOVICE LEVEL PERSON ?
YES
FILL BALLOON KITE WITH LIGHTER-THAN-AIR GAS
204
NO
208
FILL BALLOON KITE WITH AIR
212
KITE FLYING SESSION
END
216

BALLOON KITE

TECHNICAL FIELD

The present invention relates to inflatable toys and amusement devices. More particularly, the invention relates to an inflatable balloon kite structured with aerodynamic surfaces and employable as a toy and or training kite when the balloon kite is inflated with a volume of lighter-than-air gas. The lighter-than-air gas (e.g., helium) provides a buoyancy such that the balloon kite will lift and fly, even when the wind is below a critical level of wind, wherein a kite would not normally fly.

BACKGROUND ART

A large variety of toys, amusement devices, and recreational items are available in the art. One simple and well known example is a common balloon. Balloons may be filled with air, water, etc., or alternately filled with a volume of a lighter-than-air gas and made buoyant. When considering this later buoyant version, young children can be amused and entertained—at least for a short period of time. Further, decorative markings are often disposed upon surfaces of balloons to enhance their appearance and or provide a message or image appropriate for an occasion.

A relatively recent development in the art of balloons is the use of mylar sheeting materials to provide a balloon of fixed dimensions that may be embodied with a variety of decoratively covered surfaces. These mylar balloons provide a tough surface that is also difficult to puncture and pop when they come in contact with sharp or pointed objects. However, balloons are truly a simple toy. Indeed, most children will quickly become bored with this type of toy or amusement device.

Another group of amusement and hobby devices includes hobby items are common kites. Although a large variety of kites are available, many are structured with a frame made of interconnected rods suitably arranged to support a covering that aids in establishing one or more aerodynamic surfaces. It is the interaction of these aerodynamic surfaces with moving air masses, such as those available on a windy day, that enable an individual to fly and operate such a kite.

A major problem that arises when attempting to fly a kite is experienced during calm periods, wherein a low wind is present. Short of running to create a relative or artificial wind, it is simply not possible to get a kite in an aloft position and maintain it there. As a result, during low wind situations, attempts at flying and controlling a kite may prove difficult, frustrating, and possibly even upsetting.

Accordingly, it would be most desirable to have a kite or kite-like toy that would be easy for children and young individuals to fly and use. Skilled individuals will understand a need for improved, easy to fly kite-like toys that are simply structured, durable, and structured for use and operating by young children with little of no previous experience with flying kites. A number of characteristics, advantages, and associated novel features of the present invention, will become clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the present invention, a balloon kite is formed of a plurality of sized sheets, with each sheet preferably provided by a gas impervious sheet material. Each sized sheet includes edge portions and non-edge portions, which are bonded to other portions (including other edge portions) to form at least one gas-tight and fillable envelope. When these envelopes are inflated one or more aerodynamic surfaces are established. Each fillable envelope includes one or more interior chambers configured with a filling means for filling and inflating the chamber. Filling means may be provided by items such as filling ports, filling stems, etc., each of which are well understood in the art. Accordingly, it is to be understood that filling means are included to enable the filling of interior chamber(s) of the balloon kite with a selected volume of gas, as will be fully addressed further below. Once filled, the sized sheets are arranged to provide aerodynamic surfaces without additional support members or structures.

The balloon kite of the invention is intended to be used in the presence or absence of a critical level of wind. A critical level of wind is a level of wind resulting from a motion of a surrounding air mass relative to the balloon kite of the invention. It is important to understand that the terms 'critical wind' or 'critical level of wind' may actually be realized by a natural wind, which is present when the individual flying the balloon kite is substantially stationary, or by an artificial wind created by the relative movement (e.g., running) of the individual with respect to surrounding/proximate air masses. Of course, a critical level of wind may also be provided by a combination of a natural wind and an artificial wind. Accordingly, when a wind is at or above the critical level of wind, if the interior chambers of the balloon kite are filled with air, the balloon kite will lift and assume an aloft position. An operator of the balloon kite may be said to be flying the balloon kite. In this situation, the kite flies due to an interaction between the wind and the aerodynamic surfaces of the balloon kite, much like a conventional kite.

Alternately, when the wind is below the critical level of wind, if the interior chambers of the balloon kite are filled with air, the balloon kite will not lift and assume an aloft position. It is in these situations, in accordance with the invention, that the interior chambers formed within the envelope(s) of the balloon kite will most preferably be filled with a lighter-than-air gas, for example, such as helium. When the interior chambers are filled with a lighter-than-air gas, the balloon kite will exhibit a buoyancy, and may be said to 'flying', even when the wind is below the critical level of wind and the kite could not normally be flown. As fully appreciated by skilled persons, an actual critical level of wind required for a respective balloon kite, say in miles per hour, will vary according to the specific design, aerodynamics, and materials employed to construct and fly a respective embodiment of the invention. Minimal critical levels of wind may typically be somewhere in a range of 2 to 10 miles an hour, or higher.

It is contemplated that the level of entertainment and amusement experienced when flying the balloon kite may be increased, especially for younger users, with the disposing of one or more decorative graphical images upon an outer surface of at least one sheet material forming the envelopes of the balloon kite. The graphical images may be provided in the form of abstract designs, cartoon characters, reproduced personal photographic images, advertisements, business and marketing slogans, trademarks, etc.

The balloon kite in accordance with the invention is further arranged with one or more sized sheets having extended portions. Each extended portion is arranged having at least one foldable tab formed thereupon. The tabs are structured for folding over, so as to superpose an adjacent portion of the extended portion, forming a reinforced multi-layer attaching location. The attaching locations are arranged for having fixed thereto ends of a bridle, which may then have a line fixed thereto for use in controlling and flying the balloon kite. It may be noted that by employing a small amount of additional material of a sized sheet, a reinforced securing and attaching means may be readily provided with no additional items or hardware required. Further, it is to be understood that a plurality of sized sheets and extended portions may be provided by a single monolithic sheet material. For example, the embodiment of FIGS. 1, 2A and 2B, may be formed of a single sheet possibly having two substantially equivalently shaped portions that may be folded over upon each other and suitably bonded to form the desired interior chambers.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

PARTIAL LIST OF REFERENCE NUMERALS

Figure 1:
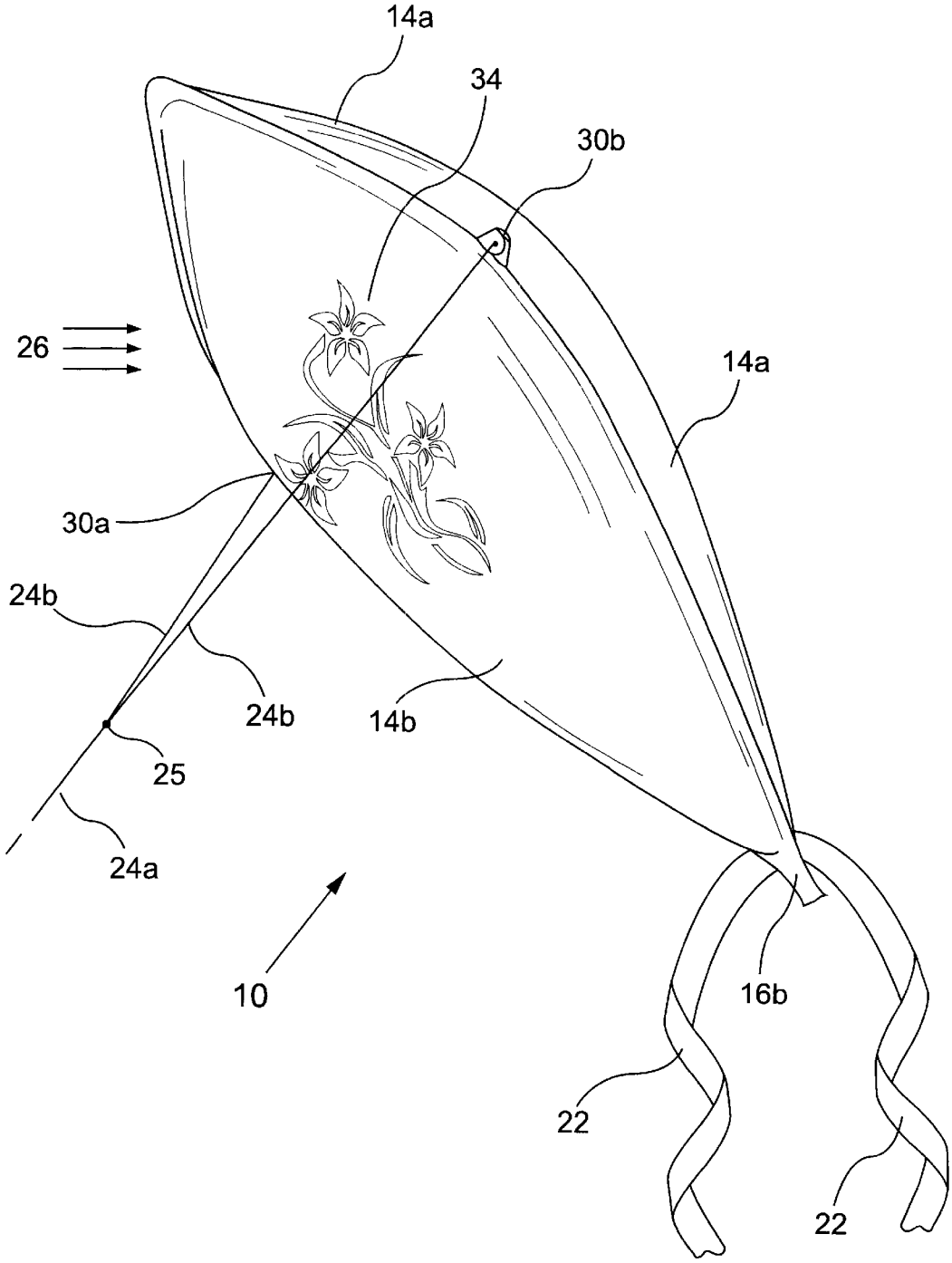
FIG. 1 is a perspective view of a first embodiment of an inflatable balloon kite in accordance with the invention with a plurality of tail portions depicted in an unfurled (uncoiled) state.

| Partial List Of Reference Numerals | |
|---|---|
| 10, 100 | balloon kite embodiments |
| 14a, 14b | sized sheets |
| 16 | (generalized) filling or inflating means |
| 16a | filling port (and plug means) |
| 16b | filling stem structure |
| 18, 118 | interior chamber(s) |
| 20 | extended portions |
| 22 | tail portions |
| 24a | kite flying line |
| 24b | bridle line |
| 26 | directional wind |
| 30a, 30b | reinforced attaching locations |
| 30ba, 30bb | tab |
| 31 | hole |
| 32 | edge portions |
| 34 | decorative graphical image |
| 114a, 114b | sized sheets of 100 |

-continued

| Partial List Of Reference Numerals | |
|---|---|
| 115a, 115b | tube envelopes |
| 120a–120d | extensions |
| 130a–130d | reinforced attaching locations |

DETAILED DESCRIPTION OF EMBODIMENTS OF THE INVENTION

Figure 2A:
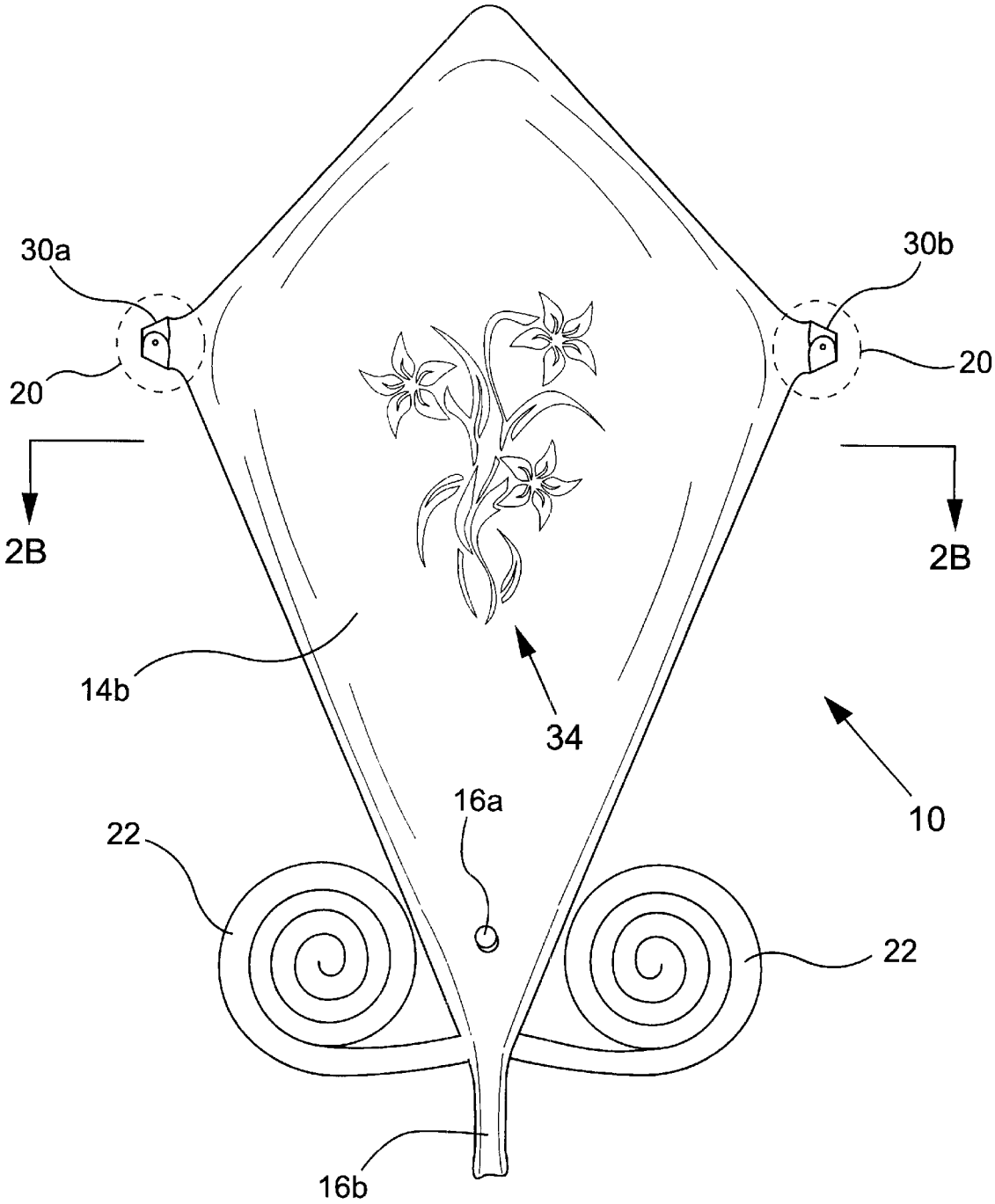
FIG. 2A is a plan view of the embodiment of the balloon kite illustrated in FIG. 1, with the tail portions in a furled (coiled) state.
Figure 2B:
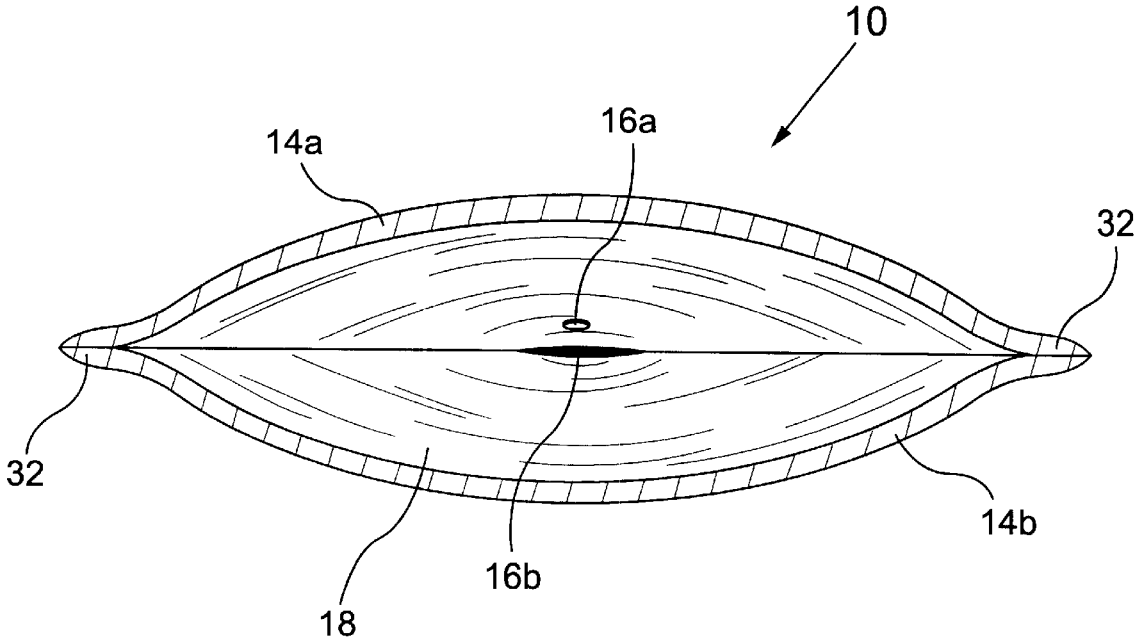
FIG. 2B is a cross sectional view of the embodiment depicted in FIG. 2A, taken along the line 2B—2B of FIG. 2A.

Referring now to the drawings, FIGS. 1, 2A and 2B depict a first embodiment of a balloon kite in accordance with the invention. The balloon kite 10 may be formed of a plurality of sized sheets 14*a* and 14*b*. The sheet 14*a* may be termed a first or top sheet, while the sheet 14*b* may be termed a second or lower sheet. It may be noted that other embodiments of the invention may include additional sized sheets, all of which may be generically referred to as sheets or sized sheets 14. Each of the sized sheets 14 has edge portions that may be fixed, as required for a respective embodiment, to other edge and or non-edge portions of the sized sheets to form at least one gas-tight envelope establishing at least one fillable interior chamber. The fixing of edge portions to other portions may be alternately termed 'bonding', and is well understood in the art.

Each balloon kite is preferably configured with a simple means to enable filling of each interior chamber 18 with a volume of air or a lighter-than-air gas, as required or desired. Once an interior chamber 18 is filled with a volume of a selected gas, a suitable filling means must enable the sealing of the chamber to secure the gas therein. Such means, which may include a simple filling port 16*a,* as best seen in FIGS. 2A and 2B, as well as a filling stem structure 16*b,* or other equivalent structures.

It may also be noted that sized sheets of the invention may be provided by any suitable material that is 'gas impervious'. For example, a preferred material may be provided by well known mylar sheeting. Skilled persons may certainly provide a number of other suitable sheeting materials that may be utilized to embody sized sheets. In addition, it must be understood that employed sheet materials may not provide absolute gas impervious characteristics. Accordingly, after an interval of time, say for example a day or a week, the loss of gas through the sized sheets may actually occur.

As can be seen in FIG. 1, the first embodiment of the invention may generally be arranged with a diamond shape when inflated. Other constructions and shapes are certainly possible. Inflating of a balloon kite 10 establishes at least one aerodynamic surface. As shown, a wind 26 flowing from the direction indicated by the arrows, will interact with aerodynamic surfaces established by sheets 14*a* and 14*b,* possibly causing the balloon kite 10 to lift. Should the level of wind be at or above a critical level of wind, then the balloon kite 10 will lift when filled and inflated with air. Alternately, should the wind be below the critical level of wind, then the balloon kite 10 would preferably be filled with a volume of lighter-than-air gas, with a resulting buoyancy causing the balloon kite 10 to rise and assume an aloft position—seemingly flying even with this inadequate wind level. Therefore, the term 'critical wind' may be realized by: a natural critical level of wind, which is present when the individual flying the balloon kite is substantially stationary; or an artificial critical level of wind created by the relative movement (e.g., running) of the individual with respect to surrounding/proximate air masses; or a combination of natural and artificial levels of wind.

As shown in FIG. 1, a bridle 24*b* and kite flying line 24*a* may be suitably arranged to enable an operator to fly and control the kite 10. For example, as shown ends of a bridle 24*b* may be fixed to reinforced attaching location 30*a* and 30*b*. However, it should be noted that bridle lines 24*b* may be composed of any number of segments (not just two as illustrated), possibly converging at a nexus 25. For example, if there are three attaching locations provided, the bridle line 24*b* may be formed with 3 segments (with a second end of each segment forming a nexus 25, which is fixed to a kite flying line 24*a*.

Another aspect of the invention is provided by tail portions 22, as shown in FIGS. 1 and 2A. As is well known, many kite designs and configurations require tail portions that provide for controlled and stable flying characteristics. As such, it would certainly be desirable to construct and provide simple, low cost tail portions for use with the present invention. As can be seen in FIGS. 1 and 2A, tail portions 22 may be provided at a lower end of the balloon kite 10 as illustrated, proximate to filling stem structure 16*b*. In a most preferred embodiment of the invention, the tail portions 22 would be formed of the same sheet materials employed to provide sized sheets 14*a* and 14*b*. Accordingly, portions of a sheet or sheet material which are processed to form sized sheets 14*a* or 14*b*, may be cut and formed, possibly employing perforations along desired tearing lines forming a coil. As can be seen in FIG. 2A, the tail portions may be initially provided in an furled or coiled state. At a time of inflating and setting up the balloon kite 10 for flying, the tail portions 22 may be unfurled and extended—thereby serving as a somewhat traditional tail of a kite. Therefore, the tail portions 22 may be readily and efficiently provided using the same sheet material used for forming other portions of a respective balloon kite. It should be understood that although two tail portions 22 are depicted in FIGS. 1 and 2A, a larger plurality of the tail portions 22 may certainly be provided.

Figure 3A:
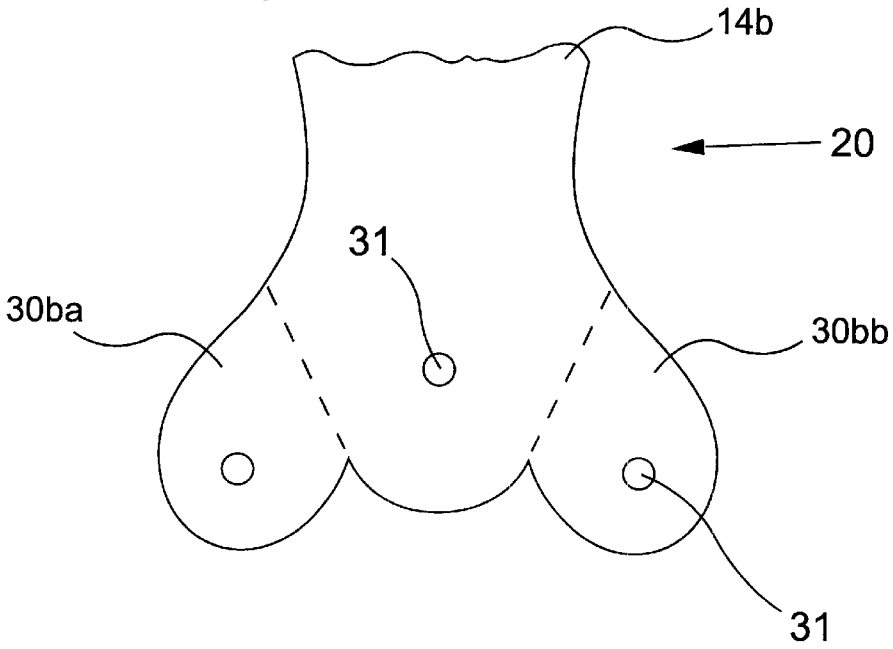
FIGS. 3A and 3B depict an extended, reinforced attaching location of a sized sheet in each of a non-folded and folded configuration, respectively.
Figure 3B:
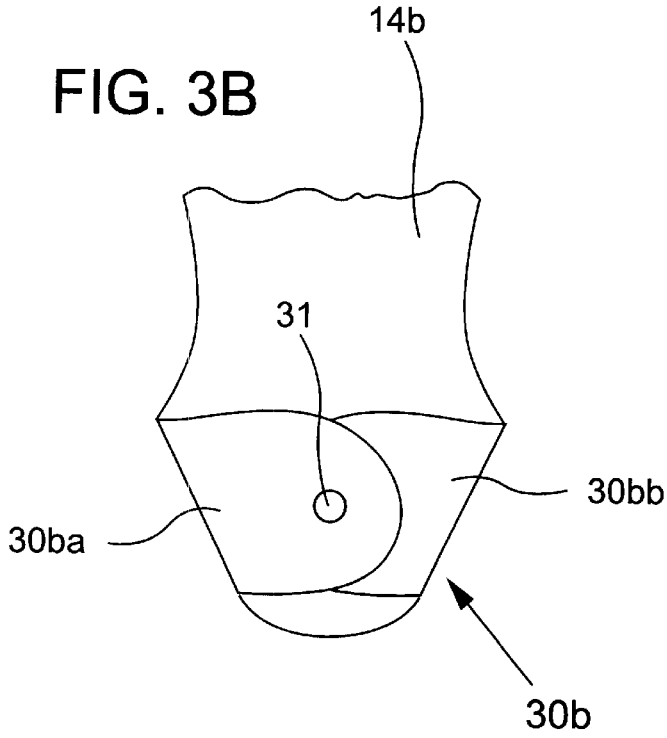

Another aspect of the invention provides a structure, using extended and folded portions of sized sheets such as 14*a* and 14*b* to enable a securing and fixing of a bridle 24*b*, or equivalents, to a balloon kite 10 of the invention. As can be best seen in FIGS. 3A and 3B, at least one sized sheet, such as sheet 14*b*, may be structured having extended portions 20, which are formed by extending edge portions of the sized sheet 14*b*. The extended portions 20, each have at least one tab, such as tab 30*ba* and tab 30*bb* formed thereupon. Each of the tabs 30*ba*, 30*bb*, etc., are structured for folding and superposing upon an adjacent portion of the extended portion 20 forming a reinforced multi-layer attaching location. This folded arrangement provides a multi-layer attaching location 30 as depicted in FIG. 3B. Each reinforced attaching location 30 may further include means, such as cutouts or holes 31, or possibly suitable grommet means (not illustrated), which may be arranged for enabling an individual to securely fix an end of a bridle line 24*b* to respective attaching locations of the balloon kite 10. It may be noted that the extended portions 20 may be formed on one sheet 14*a* or 14*b*, or upon a plurality of differing sized sheets 14, as required or desired. As can be clearly seen in FIGS. 1 and 2A, preferable embodiments of the invention may provide extended portions with attaching locations 30 that are formed by extended portions that are diametrically positioned at opposing outer peripheral portions of the balloon kite 10. However, it is certainly contemplated that additional attaching locations may be provided, preferably at other locations about the outer portions of the balloon kite 10. In addition, it may be desired to provide a plurality of attaching locations 30 that are placed in a substantially juxtaposed arrangement (not illustrated) on each side of a balloon kite 10. Such an arrangement would enable an individual preparing to fly a balloon kite 10 to select a most desired attaching location 30 based on a plurality of parameters. Several contemplated parameters may include the type of gas used to inflate the balloon kite, the level of wind available, the length of kite flying string used to fly the balloon kite, etc.

Turning again to FIG. 2A, another aspect of the invention is depicted. As shown, a region or area of one or more sized sheets may have an outer surface (as shown) having disposed thereupon one or more decorative graphical images 34. The graphical images 34 may be included to increase a level of entertainment and amusement experienced when flying the balloon kite 10, especially for younger users. The graphical image 34 may be multi-colored and provided in the form of abstract designs, cartoon characters, reproduced personal photographic images, advertisements, business and marketing slogans, trademarks, etc.

Figure 4A:
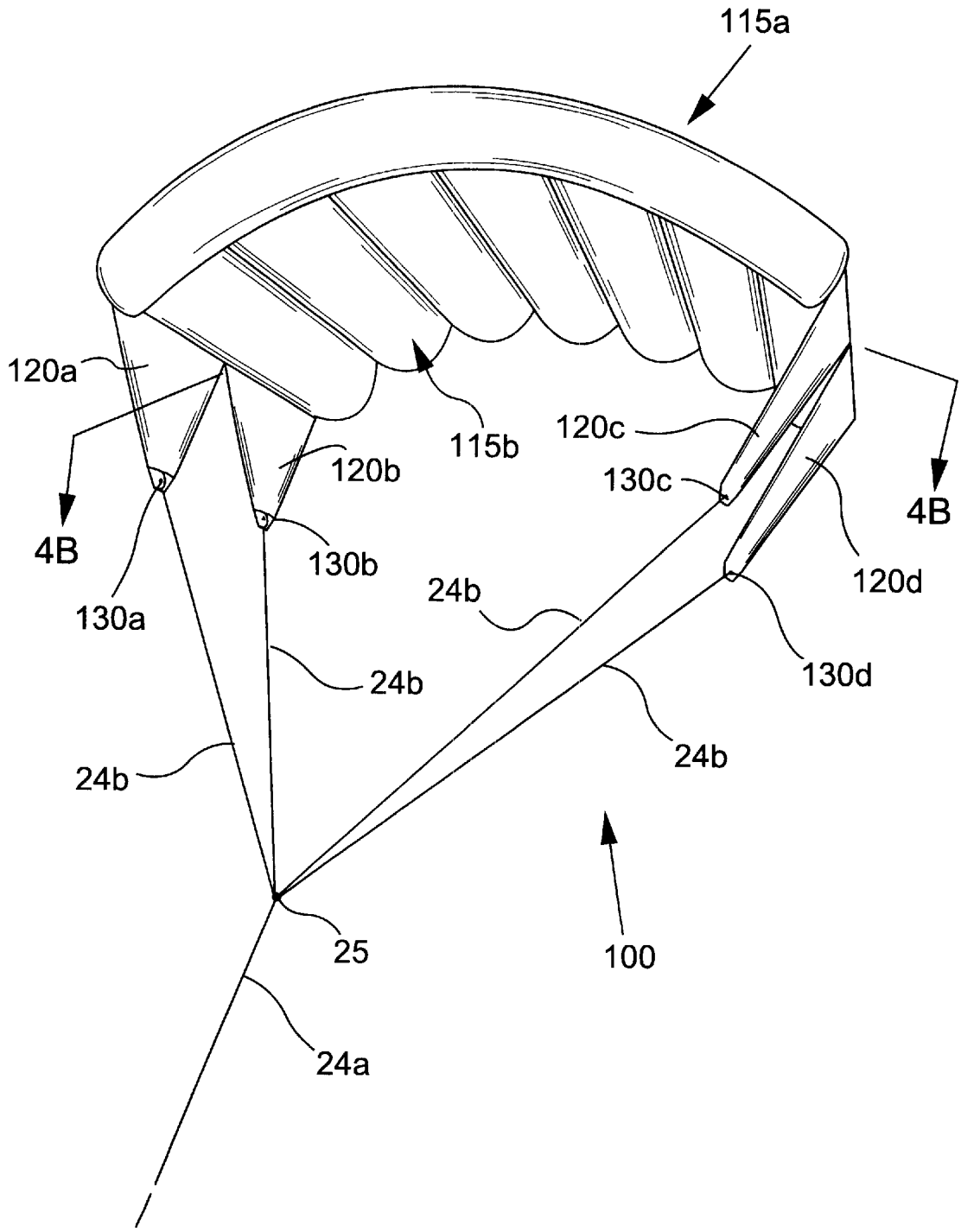
FIG. 4A is a perspective view another embodiment of a balloon kite of the invention.
Figure 4B:
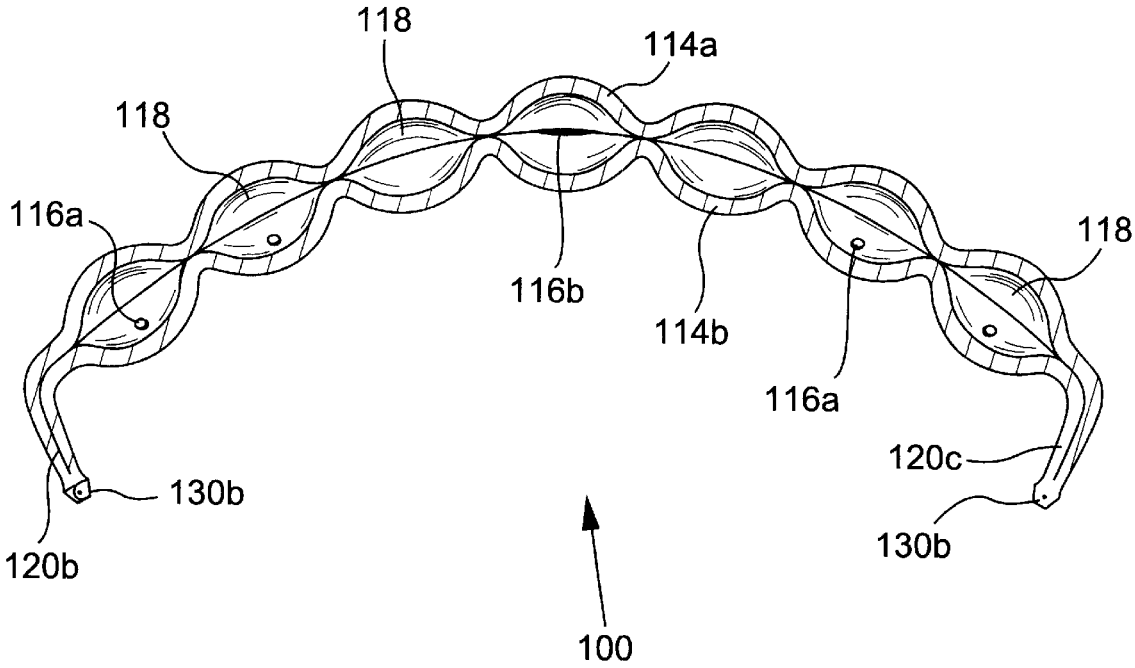
FIG. 4B illustrates is a sectional view of the embodiment of FIG. 4A, taken along the line 4B—4B as shown in FIG. 4A.

Referring now to FIGS. 4A and 4B, a second of a number of other possible alternate embodiments of the invention is illustrated. A balloon kite 100 is formed of two sized sheets 114*a* and 114*b*, as best seen in FIG. 4B. As depicted, the sheets 114 are structured and bonded in the form of what may be termed a parasail configuration. This embodiment is preferably provided with a plurality of interior chambers 118, also best seen in the sectional view of FIG. 4B. Each interior chamber 118 may be filled by way of a filling port 116*a* or a filling stem structure 116*b*. These filling means are equivalent to the filling means 16*a* and 16*b*, as discussed above. As skilled persons will appreciate, it is possible that embodiments of the balloon kite 100 may be provided wherein a single filling means, such as 116*a* or 116*b*, that may be arranged to fill each and every interior chamber 118. Alternately, a plurality of filling means may be provided wherein each filling means may enable the filling of a single chamber or a plurality of chambers. For example, as shown in FIG. 4A, a number of juxtaposed tube envelopes 115*b* may be provided wherein each may be individually fillable. One or more additional tube envelopes, such as transverse tube envelope 115*a* may also be included for maintaining a desired parasail shape when the balloon kite 100 is inflated and flying.

As can be further seen in FIG. 4A, one or both sized sheets may include extensions such as 120*a* through 120*d*, which represent more pronounced and elongated versions of the extended portions 20 discussed above. For convenience, the extensions 120*a* through 120*d*, may be collectively designated extensions 120. Importantly, each extension 120 preferably includes folded reinforced attaching locations such as 130*a* and 130*b* at an end location. The attaching locations 130 may be realized at diametrically opposing perimeter locations, and are most preferably provided as discussed above, and illustrated in FIGS. 3A and 3B. As shown in FIG. 4A, the extensions 120 may be of a shorter configuration (e.g., 120*a*) or a longer configuration (e.g., 120*d*).

The balloon kites of the invention, such as balloon kites 10 and 100, may be structured and embodied with a wide variety of sheet materials. However, at present a most preferred sheet material may be provided by one or more available mylar types of sheeting. As skilled persons will appreciate, mylar sheeting, and equivalents thereto, provide a tough sheeting material that is inexpensive, easy to cut, and may be readily bonded as needed to other mylar sheet portions.

Figure 5:
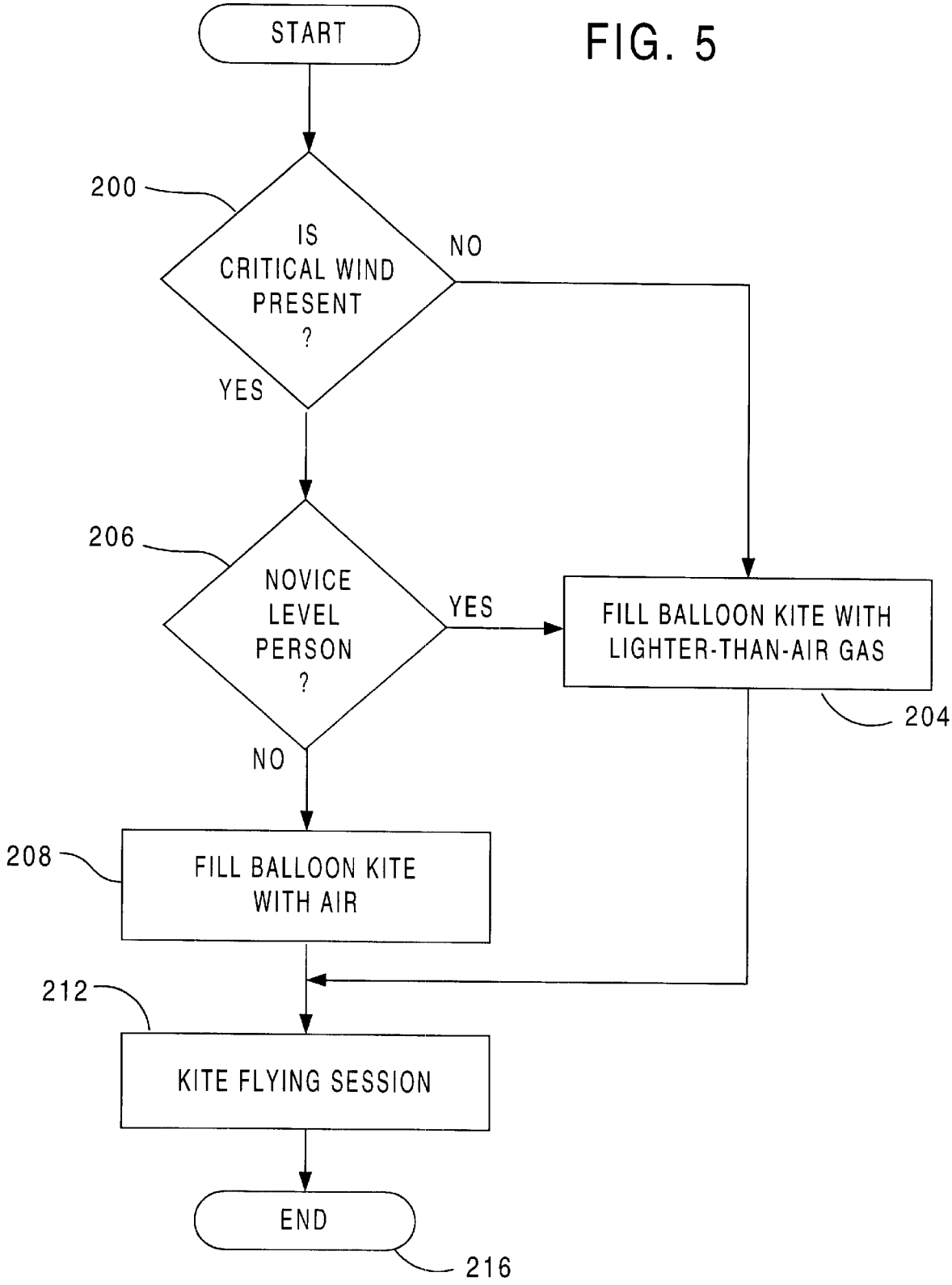
FIG. 5 illustrates a method of using and/or training an individual to fly a kite.

Referring now to FIG. 5, a method of using and or training an individual to fly a kite in any wind condition between a pre-selected range of wind conditions will be provided. The method essentially enables an individual to fly an inflatable balloon kite 10 of the invention with an insufficient wind, below the critical level of wind, as well as in conditions wherein the wind is above the critical level of wind. The method also provides for a consideration of the skill level of a user or operator of the balloon kite 10.

As shown, at 200 the method may commence with an evaluation of a present wind level. If the wind or level of wind is not sufficient to lift the balloon kite (when filled with air), no consideration is given to the user's skill level and the balloon kite 10 is most preferably filled with a lighter-than-air gas such as helium at 204. If at 200, the wind is determined to be sufficient, for example at or above the critical level of wind, then at 206 a determination is made of the skill level of a user. If at 206, the user is determined to be of a novice skill level, the balloon kite 10 is filled with a volume of lighter-than-air gas at 204. However, if the skill level at 206 is determined or assumed to be of a non-novice level (with a wind at or above a critical level of wind), the balloon kite 10 is preferably filled mostly or entirely with air. Once the balloon kite 10 is inflated and configured with a bridle and kite flying line, at 212 a kite flying session may commence.

It should be noted that the present invention provides for a filling of the balloon kite 10 via a variety of approaches. For example, if the user or operator is determined to have a skill level that is low and considered in a novice range, the balloon kite 10 may most preferably be completely filled with a volume of lighter-than-air gas. As the operator's skill level increases, a proportion or mixing may be provided. Accordingly, the proportion of gas used for filling of the balloon kite may most easily be established by filling one or more chambers with air, and the remaining chambers with lighter-than-air gas. Importantly, the desired proportion may be affected by a number of parameters including the level of wind, the structure of the particular balloon kite, the length and weight of an employed kite flying line, as well as consideration of a user's skill level.

While there have been described a plurality of the currently preferred embodiments of the present invention, along with contemplated methods of operation and use, those skilled in the art will recognize that other and further modifications may be made without departing from the invention. For example, the balloon kite of the invention may be provide in numerous other shapes and configurations, many having a larger plurality of sized sheets that are suitably coupled and fixed together. Accordingly, the foregoing descriptions of the specific embodiments of the present invention have been presented for the purposes of illustration and description. They are not intended to be exhaustive or to limit the invention to the specific forms disclosed, and obviously numerous modifications and alterations are possible in light of the above teachings. Therefore, it is fully intended to claim all modifications and variations that fall within the scope of the described invention and the appended claims.

What is claimed is:

1. A balloon kite comprising:

a) a plurality of sized sheets constructed of a gas impervious sheet material;

b) each sized sheet having portions including edge portions that are bonded to other portions forming at least one gas-tight envelope establishing at least one fillable interior chamber;

c) at least one sized sheet including extended portions, with each extended portion having a plurality of folding tabs formed thereupon, each folding tab structured for folding over upon an adjacent portion of the extended portion forming a multi-layer attaching location which is arranged for fixing thereto an end of a bridle; and d) means to enable filling of the interior chambers with a volume of either air or a lighter-than-air gas;

e) the sized sheets composing the balloon kite arranged to provide one or more aerodynamic surfaces when the kite balloon is fully inflated.

2. The balloon kite in accordance with claim 1, wherein the balloon kite is structured to:

a) be buoyant and assume an aloft position when inflated with a volume of lighter-than-air gas, whether a critical level of wind is present or not present; or b) assume an aloft position when flying in the presence of a critical level of wind when interior chambers are inflated with a volume of air.

3. The balloon kite in accordance with claim 1, wherein only two sized sheets form the envelope.

4. The balloon kite in accordance with claim 3, wherein at least one sized sheet of a plurality of sized sheets includes extended portions arranged for providing reinforced multi-layer attaching locations.

5. The balloon kite in accordance with claim 1, wherein the sized sheets and extended portions are formed of a single monolithic sheet material having two substantially equivalently shaped portions.

6. A balloon kite comprising:

a) a plurality of sized sheets constructed of a gas impervious sheet material;

b) each sized sheet having portions including edge portions that are bonded to other portions forming at least one gas-tight envelope establishing at least one fillable interior chamber;

c) at least one sized sheet including extended portions, with the extended portions having at least one tab formed thereupon, each tab structured for folding over upon an adjacent portion of the extended portion forming a multi-layer attaching location which is arranged for fixing thereto an end of a bridle;

d) means to enable filling of the interior chambers with a volume of either air or a lighter-than-air gas;

e) at least one sized sheet structured with a coiled tail portion, with each tail portion being extendable when uncoiled and useful for stabilizing a balloon kite when in an aloft position;

f) the sized sheets composing the balloon kite arranged to provide one or more aerodynamic surfaces when the kite balloon is fully inflated.

7. The balloon kite in accordance with claim 6, wherein the attaching locations formed by extended portions are spaced and diametrically positioned at opposing outer perimeter locations of the balloon kite.

8. The balloon kite in accordance with claim 7, wherein each extended portion is arranged for fixing thereto an end of a bridle line, which is in turn arranged for having fixed thereto an end of a kite flying line that may be used for deploying and flying the balloon kite in a controlled manner.

9. The balloon kite in accordance with claim 6, wherein an outer surface of at least one of the sized sheets of the balloon kite is arranged with a decorative graphical image disposed there upon.

10. An inflatable balloon kite structured having at least one aerodynamic surface included for providing a lift to the balloon kite, when inflated, in the presence of a critical level of wind, the balloon kite comprising:

a) at least one gas-tight envelope establishing at least one fillable interior chamber, each gas-tight envelope formed by bonding a plurality of sized sheets of a gas impervious sheet material, with each sized sheet having portions that are bonded to other sheet portions to form each gas-tight envelope;

b) multi-layer reinforced extended portions formed by extending edge portions of at least one sized sheet, each extended portion including a plurality of folding tabs, wherein each folding tab is structured for folding over upon an adjacent portion of the extended portion;

c) each extended portion thereby reinforced by having superposed, attached, overlaying tabs of folded sheet material portions, which are specifically structured for coupling thereto an end of a bridle;

d) the balloon kite structured, when inflated, having one or more aerodynamic surfaces that will provide a lift and support the balloon kite in an aloft position when a wind is present at or above a critical level of wind.

11. The balloon kite in accordance with claim 10, wherein a means is provided for enabling a filling and sealing of each interior chamber of the envelope.

12. The balloon kite in accordance with claim 11, wherein each interior chamber of the balloon kite is fillable with a volume of a lighter-than-air gas, thereby enabling a placing of the balloon kite in an aloft position even in the absence of a critical level of wind.

13. The balloon kite in accordance with claim 11, wherein each interior chamber of the balloon kite is fillable with a volume of a air, enabling a placing of the balloon kite in an aloft position only in the presence of a critical level of wind.

14. The balloon kite in accordance with claim 10, wherein each extended portion is structured forming a reinforced attaching location configured for fixing thereto an end of a bridle, the bridle configured to accept an end of a line that may be used to deploy and fly the balloon kite, and subsequently retract the balloon kite.

15. The balloon kite in accordance with claim 10, wherein at least one of the sized sheets of the balloon kite has disposed thereupon a decorative graphical image.

16. The balloon kite in accordance with claim 10, wherein a plurality of interior chambers are provided, with a plurality of these interior chambers having means to enable a selective filling with either a volume of one of:

a) air; or b) a lighter-than-air gas.

* * * * *